US006742863B2

(12) United States Patent
Takahashi

(10) Patent No.: US 6,742,863 B2
(45) Date of Patent: Jun. 1, 2004

(54) INK EJECTABILTY MAINTENANCE DEVICE, AND RECORDING APPARATUS INCORPORATING THE DEVICE

(75) Inventor: Nobuhito Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 29 days.

(21) Appl. No.: 10/123,524

(22) Filed: Apr. 17, 2002

(65) Prior Publication Data

US 2002/0163553 A1 Nov. 7, 2002

(30) Foreign Application Priority Data

Apr. 17, 2001 (JP) ..... P2001-118747

(51) Int. Cl.[7] ..... B41J 2/165
(52) U.S. Cl. ..... 347/33; 347/29; 347/32
(58) Field of Search ..... 347/22, 28, 29, 347/32, 33, 23

(56) References Cited

U.S. PATENT DOCUMENTS 4,825,231 A * 4/1989 Nozaki ..... 347/29
5,980,018 A * 11/1999 Taylor et al. ..... 347/31
6,158,840 A * 12/2000 Kobayashi et al. ..... 347/33
6,196,659 B1 * 3/2001 Nitta ..... 347/33
6,224,186 B1 * 5/2001 Johnson et al. ..... 347/28
6,390,595 B1 * 5/2002 Kusumi ..... 347/33

FOREIGN PATENT DOCUMENTS

EP 0 785 084 A2 * 7/1997
JP 11-138830 5/1999

* cited by examiner

*Primary Examiner*—Shih-Wen Hsieh
(74) *Attorney, Agent, or Firm*—Sughrue Mion, PLLC

(57) ABSTRACT

An ink ejectability maintenance device maintains an ink ejectability of a recording head which ejects ink droplets to a recording medium. A viper has a first moving path extending in a first direction in which the recording medium is fed, to wipe a nozzle formation face of the recording head. A cap has a second moving path extending in a vertical direction to seal the nozzle formation face. An absorption member is disposed below the first moving path to receive and absorb ink therein. The first moving path is away from the second moving path in connection with a second direction perpendicular to the first direction. A first horizontal plane in which the wiper is placed and a second horizontal plane in which the cap is placed are away from each other in the vertical direction.

17 Claims, 16 Drawing Sheets

INK EJECTABILTY MAINTENANCE DEVICE, AND RECORDING APPARATUS INCORPORATING THE DEVICE

BACKGROUND OF THE INVENTION

The present invention relates to an ink ejectability maintenance device for maintaining constant ink ejectability of a recording head for ejecting ink droplets toward a recording medium, as well as to a recording apparatus equipped with the ink ejectability maintenance device.

An ink jet printer, which is one example of the recording apparatus, is usually equipped with a print head mounted on a carriage which travels back and forth in a main scanning direction, and a medium feeder for intermittently feeding a recording medium, such as print paper, in a sub-scanning direction in preset increments. The print head is actuated in the main scanning direction while the recording medium is being fed in the sub-scanning direction, and ink droplets are ejected toward the recording medium from the print head.

A mono-color ink jet printer is usually equipped with one print head. In contrast, a full-color ink jet printer is equipped with a black-ink print head for ejecting black ink, and a plurality of color-ink print heads for ejecting various colors of ink, such as yellow, cyan, and magenta.

A print head of an ink jet printer of such a construction has a pressure generation chamber and a nozzle orifice communicated therewith. Ink is stored in a pressure generation chamber and pressurized at a predetermined pressure, whereby ink droplets of controlled size are ejected from the nozzle orifice to the recording medium. Accordingly, when variations arise in the ink ejectability of the nozzle orifice of the print head, the quality of a recorded image is greatly affected. Hence, the ink ejectability must be maintained constant at all times.

The ink ejectability is changed by various phenomena, such as an increase in viscosity or solidification due to evaporation or drying of solvent in ink by way of the nozzle orifice, clogging due to solid material, adhesion of dust to the nozzles, and intrusion of air bubbles into ink. In order to prevent occurrence of such a change in characteristic, the ink jet printer is equipped with an ink ejectability maintenance device which eliminates the above-described phenomena causing variations to maintain the ink ejectability constant.

The ink ejectability maintenance device is equipped with a capping device, a suction pump, and a wiping device. The capping device is arranged so as to seal a nozzle formation face of a print head when no recording operation is performed, thereby isolating the nozzle orifice from the outside. Thus, the ink ejectability maintenance device has the function of inhibiting evaporation and drying of ink, thereby hindering an increase in viscosity and solidification of ink. Even when the nozzle formation face is sealed with the capping device, there cannot be completely prevented occurrence of clogging due to solid material in the nozzle orifice or intrusion of air bubbles into an ink flow channel. The ink jet printer is further equipped with a suction pump for the purpose of completely preventing occurrence of these problems.

The suction pump is configured so as to exert negative pressure on the nozzle orifice while the nozzle formation face is sealed with the capping device. The suction pump has the function of forcefully causing ink to be discharged from the nozzle orifice through suction, thereby eliminating solid material or air bubbles. Forceful discharge of ink to be performed by the suction pump is usually carded out when a recording operation is resumed after the ink jet printer has remained inoperative for a long time period or when the user has actuated a specifically-designed switch provided in a control panel with the understanding that deterioration of recorded image quality.

When ink is forcefully discharged by the suction pump, ink may splash across a nozzle formation face of the printer head, and in each nozzle orifice an ink meniscus may be disturbed. The nozzle formation face of the print head becomes susceptible to adhesion of extraneous matter with lapse of time. Hence, the print head is equipped with a wiping device for wiping the nozzle formation faces as required, The wiping device has a wiping member whose base end is caught by a holder, and is constituted of an elastic plate such as rubber, An edge of the extremity of the wiping member is elastically pressed against a nozzle formation face, thereby effecting relative reciprocal movement so as to wipe the nozzle formation face As a result, ink or extraneous matter adhering to the nozzle formation face is wiped, and ink meniscuses of respective nozzle orifices are made uniform. In shoo, the wiping device has the function of making the nozzle formation face stable.

As described in Japanese Patent Publication No. 11-138830A, a related-art ink ejectability maintenance device switches between driving of a capping device and a wiping device and driving of a suction pump, through use of a single planetary gear in accordance with the rotating direction of a motor which acts as a drive source.

In the ink jet printer equipped with the related-art ink ejectability maintenance device, the capping device and the wiping device are arranged in the same direction or are slightly offset from each other; namely, in an overlapping manner, in order to suppress an increase in the size of a recording apparatus with respect to the scanning direction of a carnage. In order to prevent occurrence of interference between the wiper and the cap, there has been adopted a mechanism for reciprocally actuating the wiper in the wiping direction of the wiping device while the cap is held down, or a mechanism for reciprocally actuating the wiper and the cap in the wiping direction.

The former mechanism requires a large amount of vertical movement of the cap for preventing occurrence of interference between the cap and the wiper. Hence, the size of the capping device is increased in the sealing direction. Moreover, if the wiper is arranged so as to avoid interference between the wiper and the cap, the size of the wiping device is increased in is the scanning direction of the carriage.

If an attempt is made to perform a flushing operation in which ink is ejected within the cap during, before, or after a printing operation and to seat the nozzle with the cap after the printing operation, moisture contained in a head surface or the nozzle is absorbed by the ink after the ink has dried. Consequently, the viscosity of ink stored in the nozzle is increased, which in turn deteriorates print quality after the printer has been left for a while. Since ink accumulates in the cap during a long-time printing operation, there may arise a necessity for an operation of discharging ink from the cap during the course of a printing operation.

By the latter mechanism, the cap and the wiper are actuated together. Hence, the size of the mechanism is increased in the wiping direction. In a case where a flushing operation is performed in the space from which the cap and the wiper have departed, a distance between the nozzle and an absorbing material for receiving flushed ink becomes longer. As a result, minute ink droplets (i.e., ink mist) waft through the space, possibly contaminating the paper transport path and the exterior of the printer.

SUMMARY OF THE INVENTION

It is therefore an object of the present invention to provide an ink ejectability maintenance device capable of preventing contamination, which would otherwise be caused by ink mist stemming from flushing, as well as a recording apparatus equipped with the ink ejectability maintenance device.

In order to achieve the above object, according to the present invention, there is provided an ink ejectability maintenance device for maintaining an ink ejectability of a recording head which ejects ink droplets to a recording medium, comprising:

a wiper, having a first moving path extending in a first direction in which the recording medium is fed, to wipe a nozzle formation face of the recording head;

a cap, having a second moving path extending in a vertical direction to seal the nozzle formation fare; and an absorption member, disposed below the first moving path to receive and absorb ink therein, wherein:

the first moving path is away from the sand moving path in connection with a second direction perpendicular to the first direction; and a first horizontal plane in which the wiper is placed and a second horizontal plane in which the cap is placed are away from each other in the vertical direction.

In this devices a reduction in the size of the cap in the vertical direction while the amount of movement of the cap in the vertical direction can be minimized. Ink droplets are immediately absorbed by the absorption member without involvement of occurrence of an ink mist even when a flushing operation is performed. Further, ink droplets which have run from the wiper are absorbed immediately. Hence, there can be prevented contamination of a recording medium transporting path or an exterior of the recording apparatus.

Preferably, the ink ejectability maintenance device further comprises a driver unit including a pair of planetary gears which transmits a driving force thereof to the wiper and the cap, and a single rotor which rotates either one of the planetary gears so that the driving force is transmitted by both of a forward rotation and a reverse rotation thereof.

In this device, the cap and the wiper can be actuated independently of each other. Hence, the amount of movement of the cap in the vertical direction is minimized, and the size of the cap in the vertical direction can be reduced.

Here, it is preferable that the driver unit includes a sun gear meshed with the respective planetary gears and a partially-chipped gear connected to the wiper. The partially-chipped gear includes a cog portion which meshes either one of the planetary gears when the wiper is moved, and a cogless portion which faces either one of the planetary gears after the wiper is moved.

In this device, actuation of the cap and actuation of the wiper can be performed regardless of whether the rotor rotates forward or in reverse. Hence, the position of the cap or that of the wiper can be readily initialized. Consequently, there is obviated a necessity for setting, on a cam for actuating the cap and the wiper, a flag to be used for detecting the position of the cap and that of the wiper for initialization purpose, which has hitherto been used. Hence, an attempt can be made to facilitate assembly and adjustment of the ink ejectability maintenance device or curtail costs of the device. Further, the cap and the wiper can be placed in predetermined positions without fail by rotating merely the partially-chipped gear to the cogless portion by the planetary gear.

Here, it is preferable that the partially-chipped gear is a four-gears unit which respectively meshes the respective planetary gears, a wiper gear for driving the wiper, and a cap gear for driving the cap.

In this device, the torque of each of the planetary gears can be transmitted to the wiper gear and the cap gear thoroughly. Hence, the positioning accuracy of the cap and that of the wiper can be improved, and capping and wiping operations can be performed independently.

Here, it is preferable that the wiper gear includes a lever and a cam mechanism for moving the wiper in the first direction, and the cap gear includes a cam mechanism for moving the cap in the vertical direction.

In this device, since the wiper and the cap, which have the well-known lever and cam mechanism, the labor required for changing design can be simplified.

Preferably, the ink ejectability maintenance device further comprises a suction unit which applies negative pressure to an internal space of the cap which seals the nozzle formation face. Here, the suction unit is activated after the driver unit drives the wiper and the cap.

In this device, the suction unit is activated by rotation of the rotor in either direction. Particularly when a tube pump is employed, a pulley can be released from the tube. The tube can be prevented from remaining collapsed by the pulley without use of a special mechanism. Since capping can be effected without driving of a pump, the pump tube is not collapsed even when the capping unit is opened and closed before and after printing.

According to the present invention, there is also provided a recording apparatus comprising the above ink ejectability maintenance device.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One embodiment of the invention will be described in detail hereinbelow by reference to the accompanying drawings.

Figure 1:
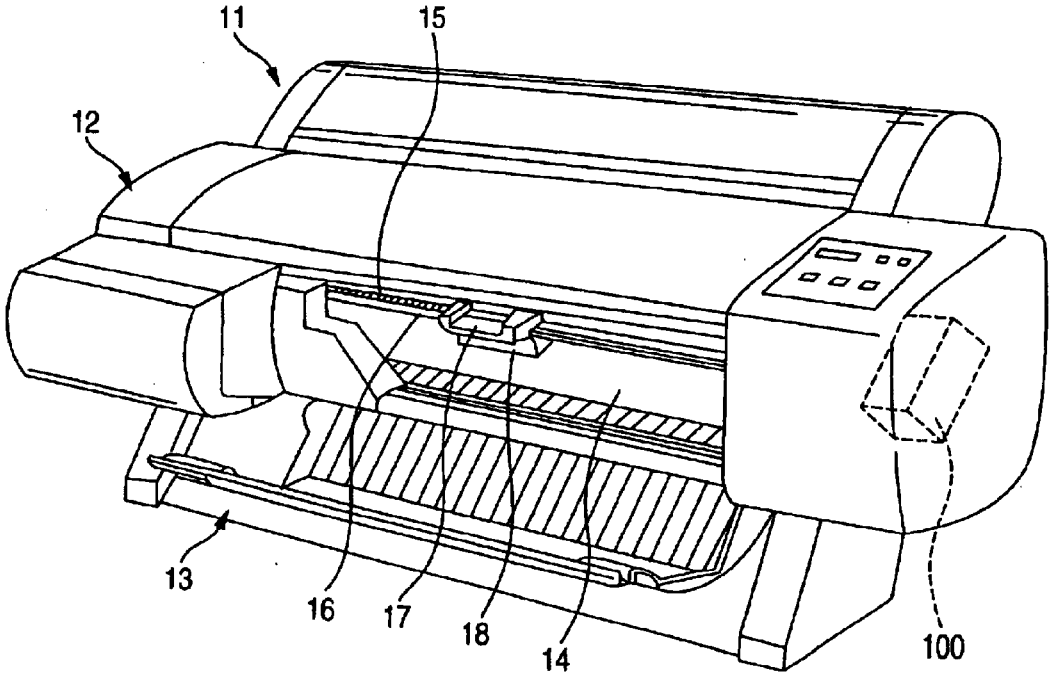
FIG. 1 is a perspective view showing a whole configuration of an ink jet printer, which is one type of recording apparatus according to an embodiment of the invention.

An ink jet printer shown in FIG. 1 is a large printer capable of printing data onto print paper of relatively large size, e.g., paper of 594 mm (JIS A1-size paper) or paper of 728 mm (JIS B1-size paper).

In the ink jet printer, a paper feed section 11, a recording section 12, and a paper discharge section 13 are aligned so as to be parallel and to assume a diagonal relationship, specifically, the lower paper discharge section 13 is located closer to the operator than is the upper paper feed section 11. Print paper is discharged outside after having been subjected to predetermined printing during the course of being supplied from the paper feed section 11 to the paper discharge section 13 by way of the recording section 12. A paper transporting path 14 constituted at the time of printing is formed at an inclination of, e.g., 65 degrees, with respect to a horizontal plane. A nozzle formation face of a print head 18 mounted on a carriage 17, which travels back and forth in the main scanning direction along a guide shaft 16 by a driving belt 15, is provided at an angle of, e.g., 65 degrees, so as to become parallel with the paper transporting path 14.

An ink ejectability maintenance device 100 for maintaining the ink ejectability of the print head 18 constant is disposed in a position which serves as the home position of the carriage 17. While the carriage 17 is situated at the home position, the ink ejectability maintenance device 100 performs an operation for maintaining the ink ejectability of the print head 18.

Figure 2:
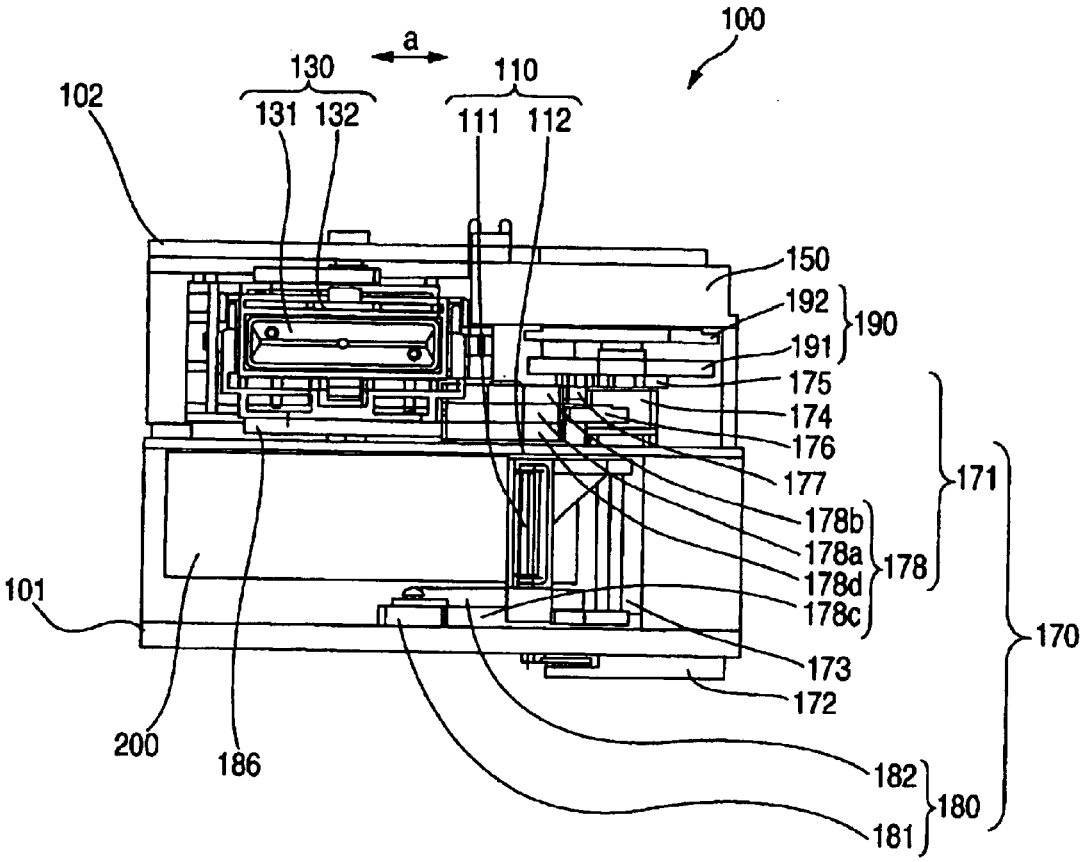
FIG. 2 is a perspective view showing an ink ejectability maintenance device according to the embodiment.
Figure 3:
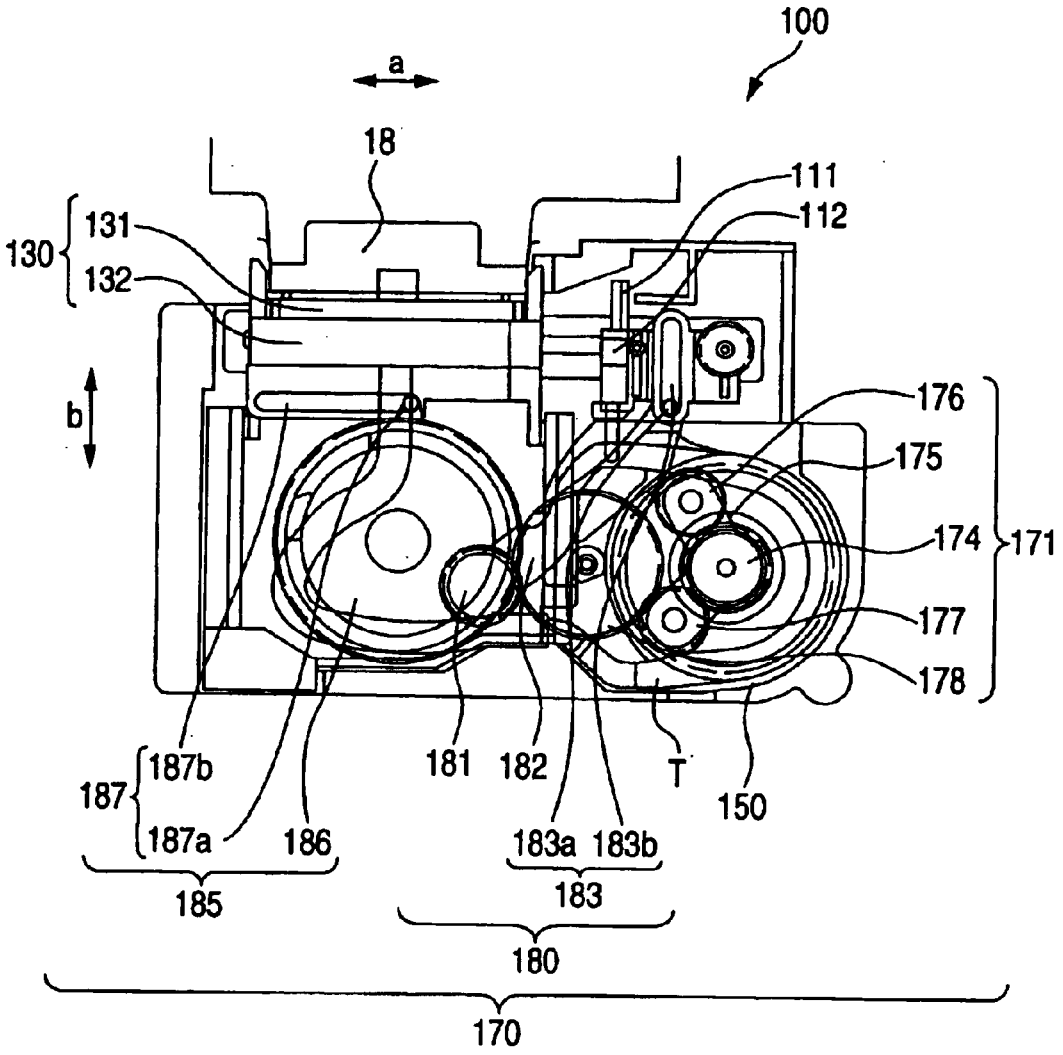
FIG. 3 is a side view of the ink ejectability maintenance device shown in FIG. 2.

As shown in FIGS. 2 and 3, the ink ejectability maintenance device 100 has wiping unit 110 for wiping a nozzle formation face in a so-called sub-scanning direction designated by arrow "a"; a capping unit 130 which is pressed against the nozzle formation face of the print head 18 at the time of non-printing operation, thereby sealing the nozzle orifice; a suction unit 150 and a wiping unit 110 for forcefully discharging ink through suction for removing clogging in the nozzle orifice or the air bubbles intruded into ink; and a driving unit 170 for driving the capping unit 130 and the suction unit 150. All these units are interposed between two side frames 101, 102 and are formed into a substantially-box-shaped unit.

The wiping unit 110 and the capping unit 130 do not overlap each other in the sealing direction of the capping unit 130; that is, a vertical direction designated by arrow "b" shown in FIG. 3. The wiping unit 110 and the capping unit 130 are offset from each other in the direction perpendicular to the wiping direction of the wiping unit 110; that is, in a so-called main scanning direction. As a result, the capping unit 130 and the wiping unit 110 can be actuated independently of each other. Hence, the size of the capping unit 130 in the sealing direction can be reduced while the amount of vertical movement of the cap 131 is minimized The suction unit 150 is disposed in a position substantially below the wiping unit 110. The driving unit 170 is disposed so that the wiping unit 110, the capping unit 130, and the suction unit 150 can operate in cooperation with each other. More specifically, the driving unit 170 actuates the wiping unit 110 in a sub-scanning direction designated by arrow "a" shown in FIGS. 2 and 3. The capping unit 130 is actuated vertically as designated by arrow "b" shown in FIG. 3, thereby activating the suction unit 150, As shown in FIGS. 2 and 3, the wiping unit 110 has a wiper 111 and a wiper holder 112. The wiper 111 is formed from rubber into a substantially-rectangular flat plate. The extremity of the wiper 111 rubs against the nose formation face of the print head 18. As a result, the wiper 111 can wipe away the ink adhering to the nozzle formation fare. The wiper 111 may be formed from felt or plastic, according to the kind of ink The wiper holder 112 is formed from plastic into the form of a substantially-rectangular plate. The wiper holder 112 is actuated in the sub-scanning direction designated by arrow "a" shown in FIGS. 2 and 3 by wiper actuator 180 constituting the driving unit 170 to be described later while holding the wiper 111 such that the extremity of the wiper 111 projects from the upper end portion of the wiper holder 112.

An absorption member 200 is disposed immediately below the travel path of the wiper 111 of the wiping unit 110. The absorption member 200 absorbs ink droplets stemming from wiping action of the wiping unit 110 or acts as a flushing receiver for receiving ink flushed for preventing an increase in the viscosity of the ink remaining in the nozzle during a printing operation. For instance, a sponge or cloth is used for the absorbing material 200. As a result, ink droplets are absorbed immediately by the absorbing material 200 through flushing operation. Further, the ink running from the wiper 111 of the wiping unit 110 is also absorbed immediately. For these reasons, there can be prevented contamination of a paper transport path or the exterior of the ink jet printer.

As shown in FIGS. 2 and 3, the capping unit 130 is equipped with a cap 131 and a cap holder 132. The cap 131 is formed from rubber in the form of a substantially rectangular parallelepiped. An indentation 131*a* formed in the top of the cap 131 is pressed against the nozzle formation face of the print head 18. The capping unit 130 can seal the nozzle orifice, The cap holder 132 is formed from plastic into the shape of a substantially-rectangular-parallelepiped, The cap holder 132 is arranged to move in the vertical direction designated by arrow "b" shown in FIG. 3 by the capping unit 185 constituting the driving unit 170 to be described later, while retaining the cap 131 such that the upper edge of the cap 131 projects from the upper face of the first cap holder 132, The suction unit 150 is a well-known pulsation pump. Upon continuous pushing of a given portion of a tube T connected to the cap 131, by a plurality of rollers provided at given locations in the rotating direction, air in the tube is fed, thereby forcefully discharging ink from the print head 18 by suction, As a result, the suction unit 150 can eliminate clogging in the nozzle orifice or air bubbles intruded into ink.

As shown in FIGS. 2 and 3, the driving unit 170 has a rotation switcher 171, a wiper actuator 180, a cap actuator 185, and a pump driver 190, The rotation switcher 171 is provided with a torque transmission gear 172 disposed so as to be outside of the side frame 101; a sun gear 174 provided coaxially with a shaft 173 of the torque transmission gear 172; a forward rotation planetary gear 176 and a reverse rotation planetary gear 177 provided in a substantially-L-shaped planetary lever 175 so as to mesh with the sun gear 174; and a partially-toothed gear 178 capable of meshing with the planetary gears 176, 177.

The partially-toothed gear 178 is constituted of the forward rotation planetary gear 176, the reverse rotation planetary gear 177, a wiper gear 181 constituting the wiper actuator 180 to be described later, and first through fourth partially-toothed gears 178*a*, 178*b*, 178*c*, and 178*d* which mesh with a wiper gear 186 constituting the cap actuator 185.

The torque transmission gear 172 transmits the torque of an unillustrated motor. In accordance with the rotating direction of the torque transmission gear 172; that is, the rotating direction of the motor, either the forward rotation planetary gear 176 or the reverse rotation planetary gear 177 is meshed with a first partially-toothed gear 178*a* or a second partially-toothed gear 178*b* by way of the planetary lever 175, thereby transmitting torque by way of the sun gear 174.

The wiper actuator 180 is provided with a wiper gear 181, a lever 182, and a cam mechanism 183. The wiper gear 181 is arranged to mesh with a third partially-toothed gear 178*c*. A cam mechanism 183 is constituted of a pin 183*a* formed integrally with one side surface of the lever 182 and a groove 183*b* formed in the wiper holder 112 One end of the lever 182 is locked as a result of the pin 183*a* being inserted into the groove 183*b*. The other end of the lever 182 is arranged coaxially with the wiper gear 181.

The cap actuator 185 has a cap gear 186 and a cam mechanism 187. The cap gear 186 is arranged to mesh with the fourth partially-toothed gear 178*d*. The cam mechanism 187 is constituted of a pin 187*a* which is provided integrally with an outer circumferential side face of the cap gear 186; and a groove 187*b* which is formed in the cap holder 132 and has the pin 187*a* inserted therein.

The pump driver 190 has a pump transmission wheel 191 and a pump wheel 192 arranged coaxially with the shaft 173 of the torque transmission gear 172. The pump transmission wheel 191 is arranged to rotate the pump wheel 192 with a time lag provided between the suction unit 150, the wiping unit 110, and the capping unit 130.

By such a configuration, the torque of the motor is transmitted from the torque transmission gear 172 to the forward rotation planetary gear 176 which meshes with the planetary lever 175 because of its rotation, by way of the sun gear 174. Alternatively, the torque is transmitted from the reverse rotation planetary gear 177 to the first partially-toothed gear 178*a* or the second partially-toothed gear 178*b* and further to the wiper gear 181 by way of the third partially-toothed gear 178*c* and the fourth partially-toothed gear 178*d*. The torque is transmitted further to the pump wheel 192 by way of the pump transmission wheel 191. As a result, the wiping unit 110 can be actuated in the sub-scanning direction, and the capping unit 130 is actuated vertically. Thus, the suction unit 150 can be activated.

Figure 4:
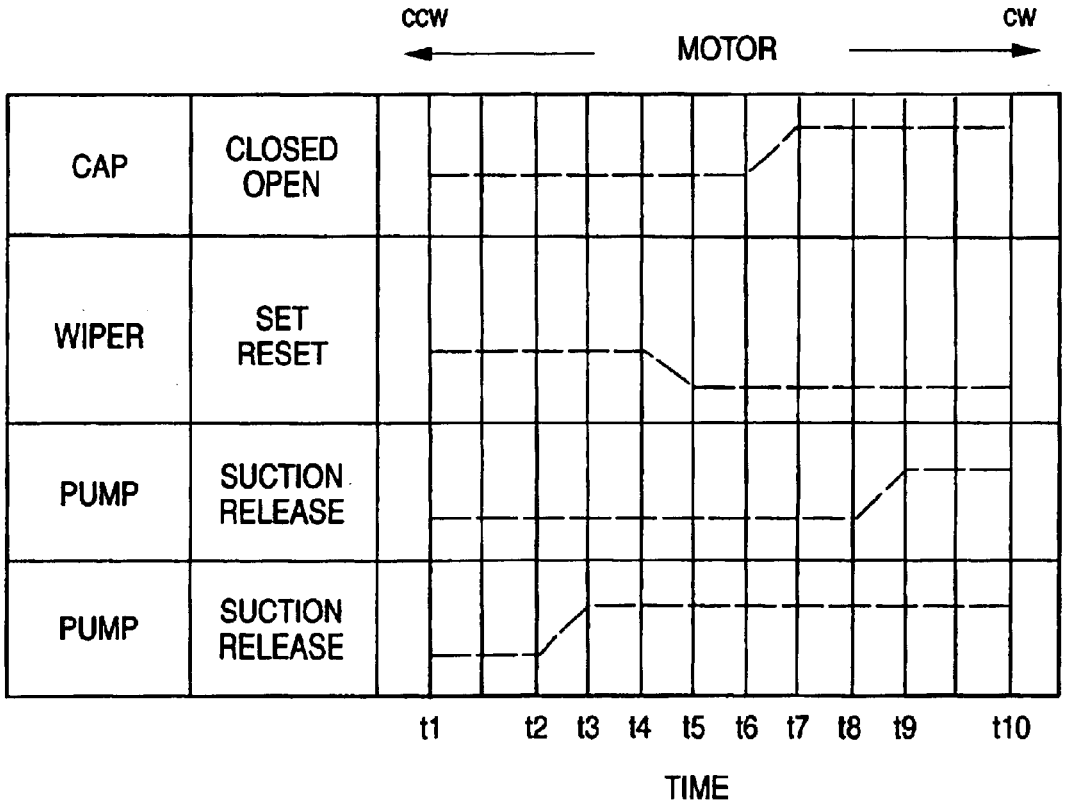
FIG. 4 is a timing chart showing an operation of the ink ejectability maintenance device shown in FIG. 2.

The entire operation of the ink ejectability maintenance device 100 having the wiping unit 110, the capping unit 130, the suction unit 150, and the actuator 170, which have the foregoing constructions, will now be described by reference to FIGS. 4 through 16. FIG. 4 is a timing chart showing an operation example of the ink ejectability maintenance device 100; FIGS. 5 through 10 show the operation of the device 100 when the motor rotates forward (CW); and FIGS. 11 through 16 show the operation of the device 100 When the motor rotates in reverse (CCW).

Figure 5:
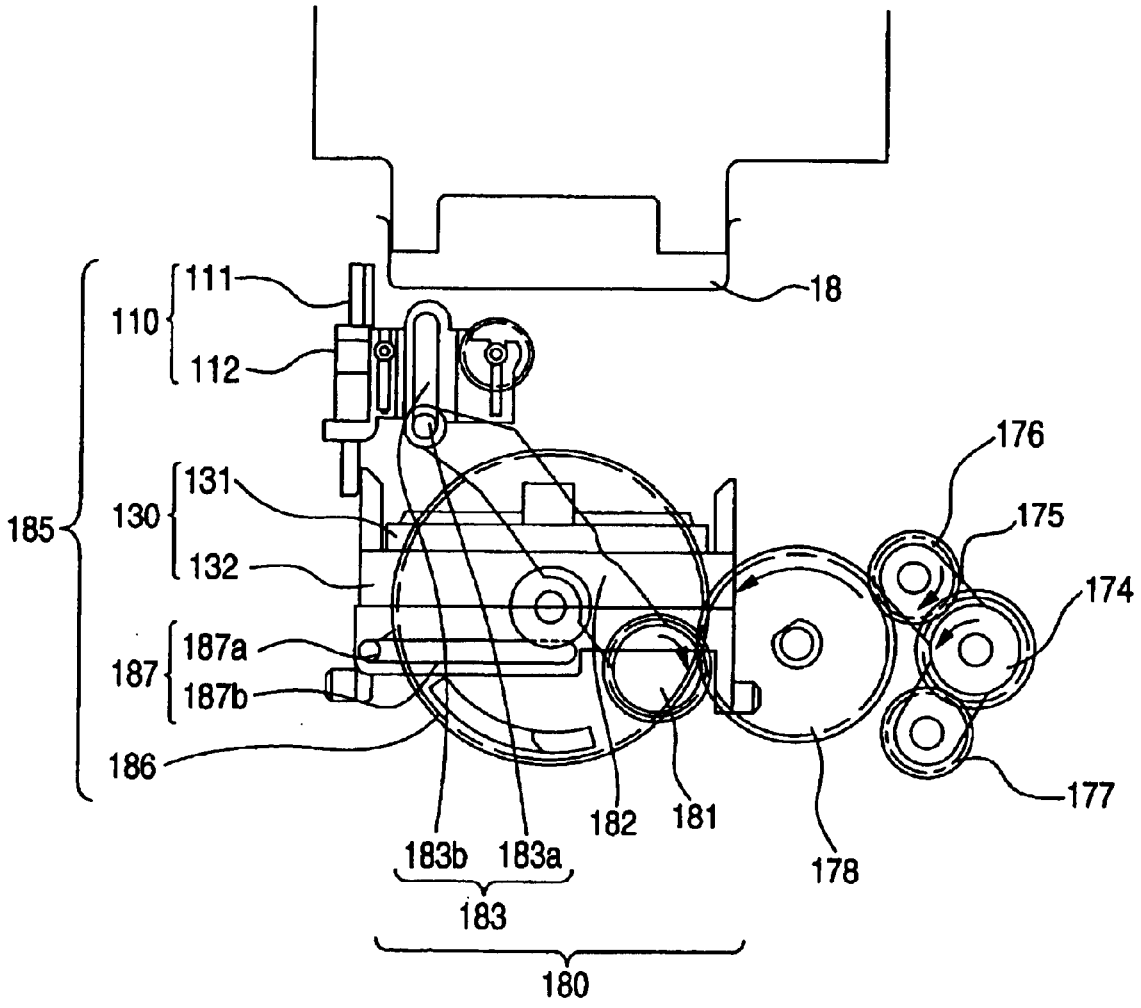
FIGS. 5 through 16 are views showing the operation of the ink ejectability maintenance device shown in FIG. 2.
Figure 6:
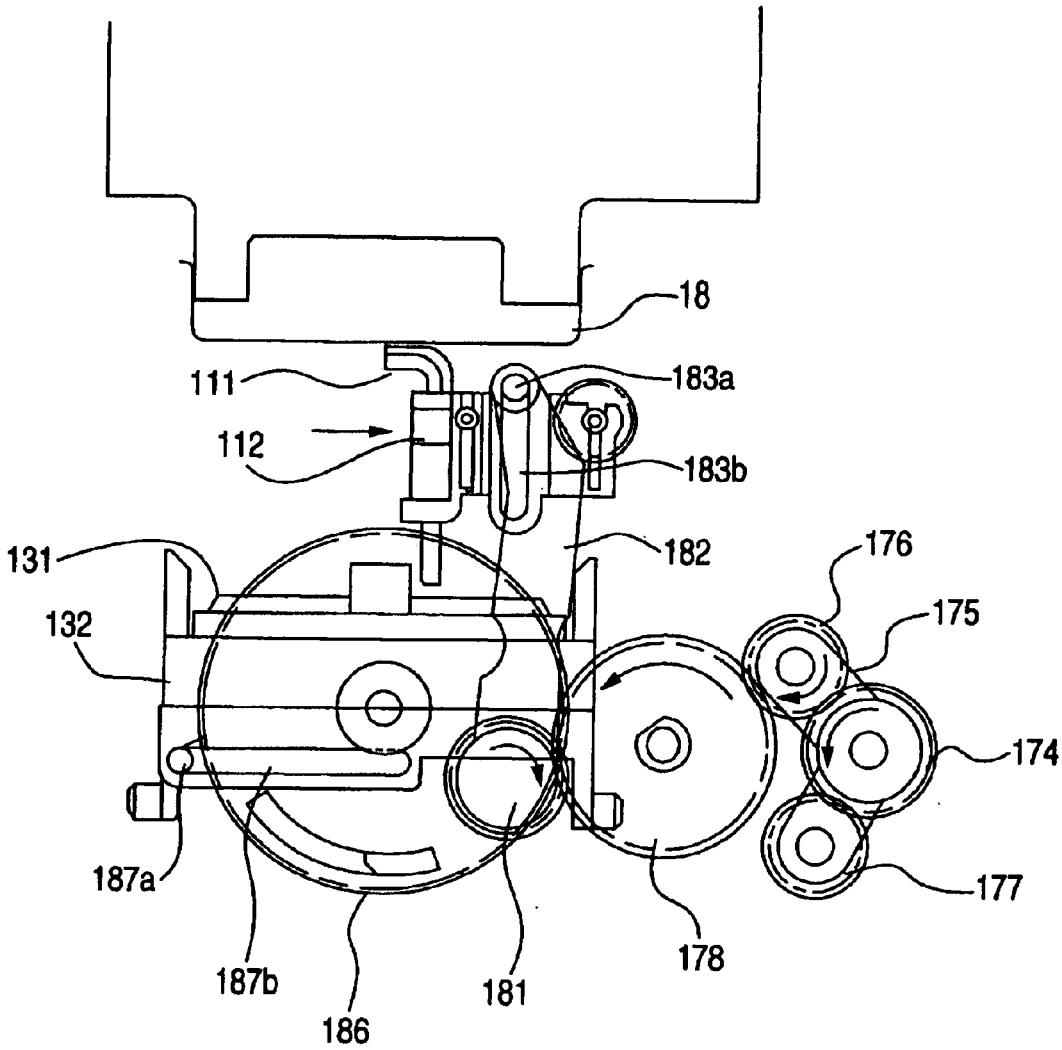

As shown in FIG. 5, when the motor rotates forward in the manner as shown in FIG. 4, the capping unit 130 is situated in the lowermost end position The cap 131 is in an "open" state; that is, an uncapped state. Moreover, the wiping unit 110 is situated in a higher position. The wiper 111 remains in a "set" state; that is, a wipe-enable state. The roller of the pump; that is, the suction unit 150, remains in a "released" state with respect to a tube; ie., a non-sucking state (point in start time t1).

When in this state the motor is driven in a forward rotation direction, to thereby rotate the planetary lever 175, the forward planetary gear 176 meshes with the first partially-toothed gear 178*a*. The torque of the sun gear 174 is transmitted from the forward rotation planetary gear 176 to the first tooth-toothed gear 178*a* and from the third partially-toothed gear 178*c* to the wiper gear 181 A lever 182 pivots, and the wiper holder 112 starts moving in the rightward direction in the drawing by the cam mechanism 183 (point in time t4). The wiper 111 wipes the nozzle formation face of the print head 18.

Figure 7:
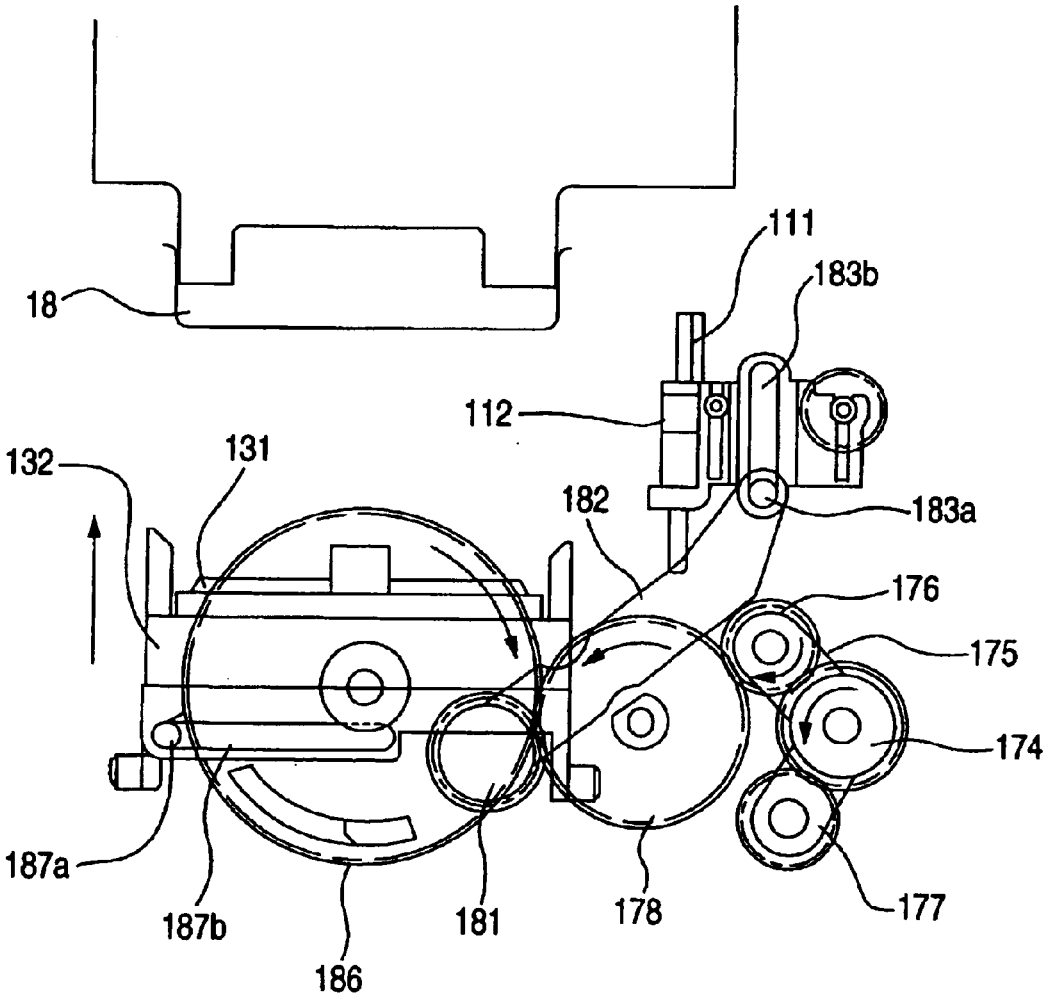

When the wiper gear 181 has been disengaged from a toothless section of the third partially-toothed gear 178*c* upon reaching the same, a wiper gear 181 runs idly. As shown in FIG. 7, the wiper holder 112 stops moving. At this time, the wiping unit 110 is situated in the rightmost position in the drawing. The wiper 111 remains, in a "reset" state; that is, a state in which a wiping action toward the rightward direction in the drawing has been completed (point in time t5).

During the period of points in time t1 through t5, the fourth partially-toothed gear 178*d* also rotates. However, presence of the partially-toothed portion prevents transmission of torque to a gap gear 186. Hence, the cap 131 still remains stationary in the lowermost position.

Figure 8:
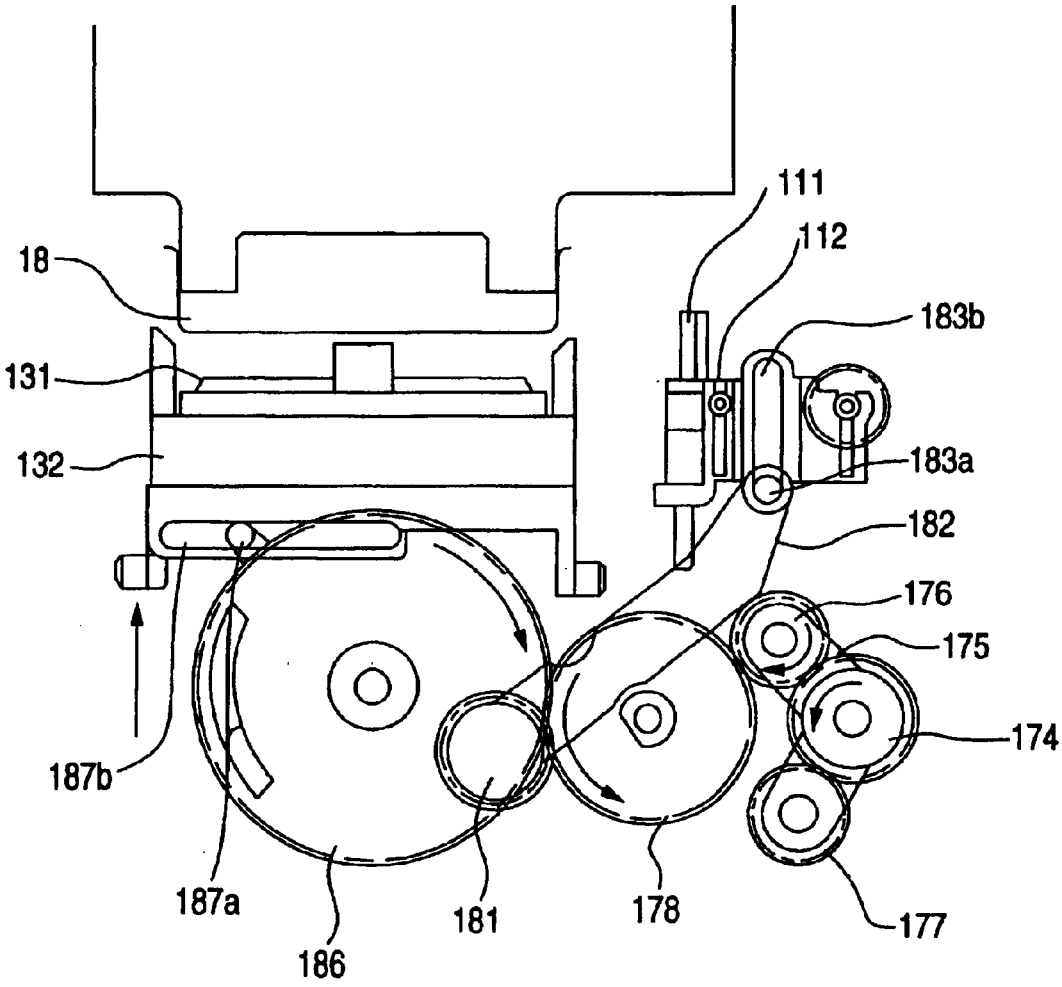
Figure 9:
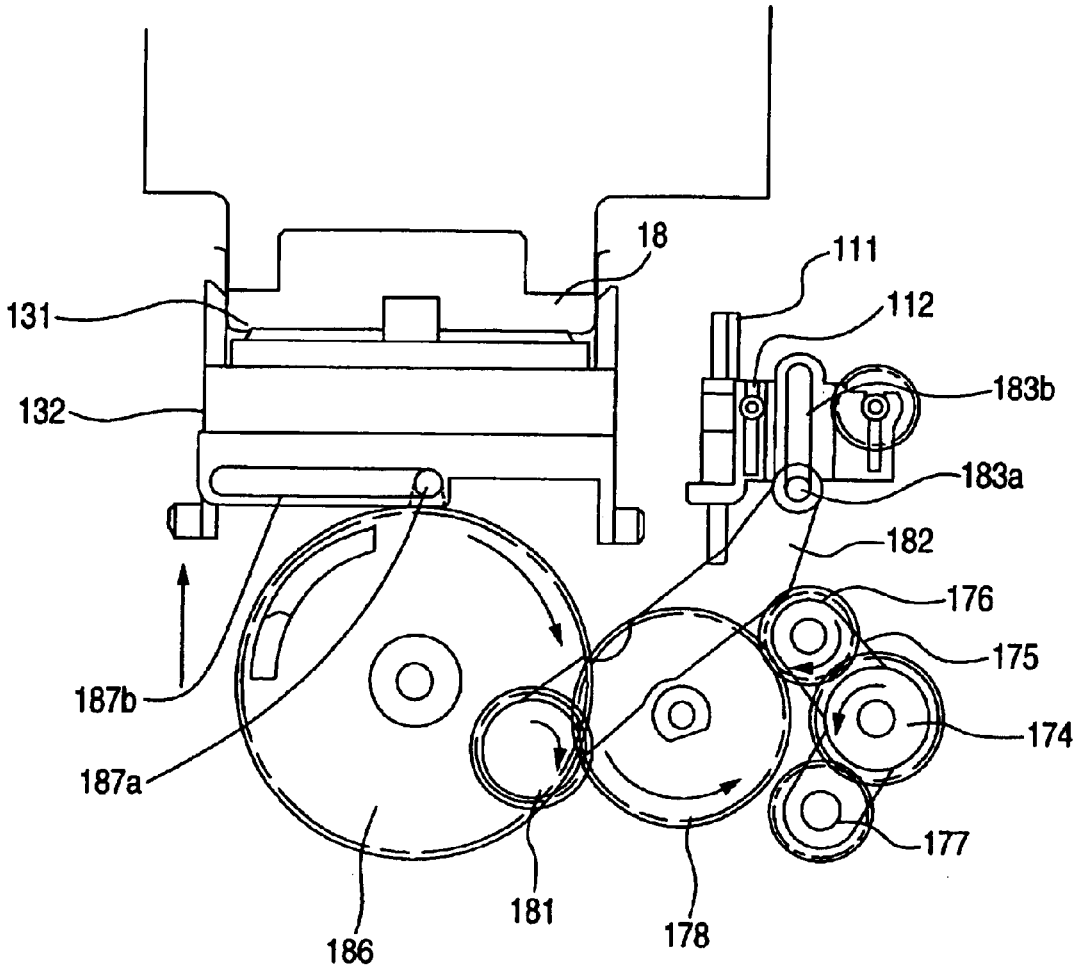

When the motor rotates forward to rotate the torque transmission gear 172, the torque of the sun gear 174 is transmitted from the forward rotation planetary gear 176 to the first partially-toothed gear 178*a* and from the fourth partially-toothed gear 178*d* to the cap gear 186 in the manner as shown in FIG. 7, whereupon the cap holder 132 starts rising by the cam mechanism 187 (point in time t6). As shown in FIG. 8, the cap 131 approaches the print head 18, and the cap 131 seals the nozzle formation face of the print head 18 in such a manner as shown in FIG. 9.

Figure 10:
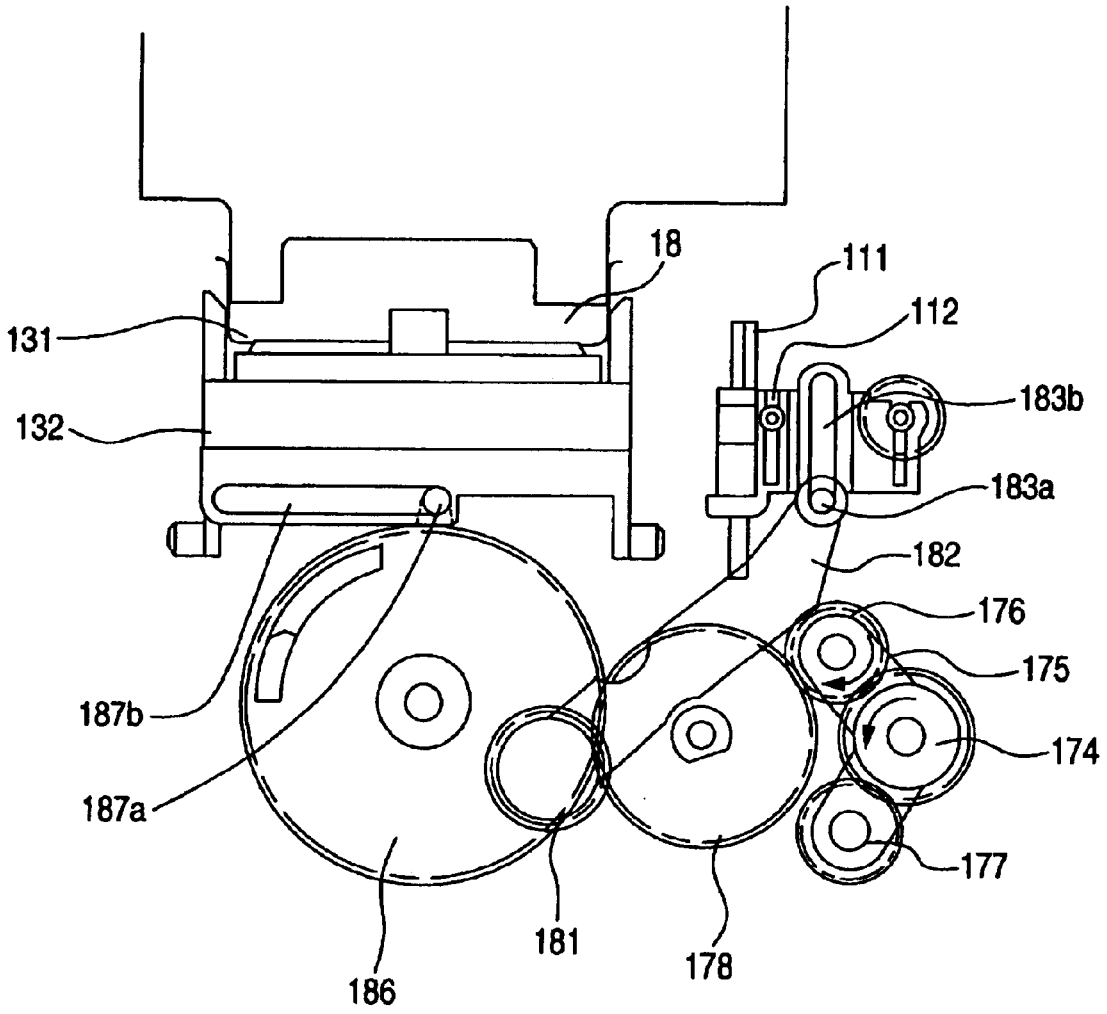

When the cap gear 186 has been disengaged from the fourth partially-toothed gear 178*d* upon reach a partially-toothed portion of the gear 178*d*, the cap gear 186 runs idly. As shown in FIG. 10, the cap holder 132 stops rising. At this time, the capping unit 130 is situated in the highest end position, and the cap 131 is in a "closed" state; namely, a capped state (point in time t7).

When in this state the motor rotates further forward, to thereby rotate the torque transmission gear 172, the pump wheel 192 starts rotating by way of the pump transmission wheel 191, thereby activating the suction unit 150. At this time, the roller of the pump has bitten the tube; that is, the roller is in a sucking state (points in time t8, t9). In this way, no torque is transmitted to the pump while the wiping unit 110 and the capping unit 130 are in operation.

Figure 12:
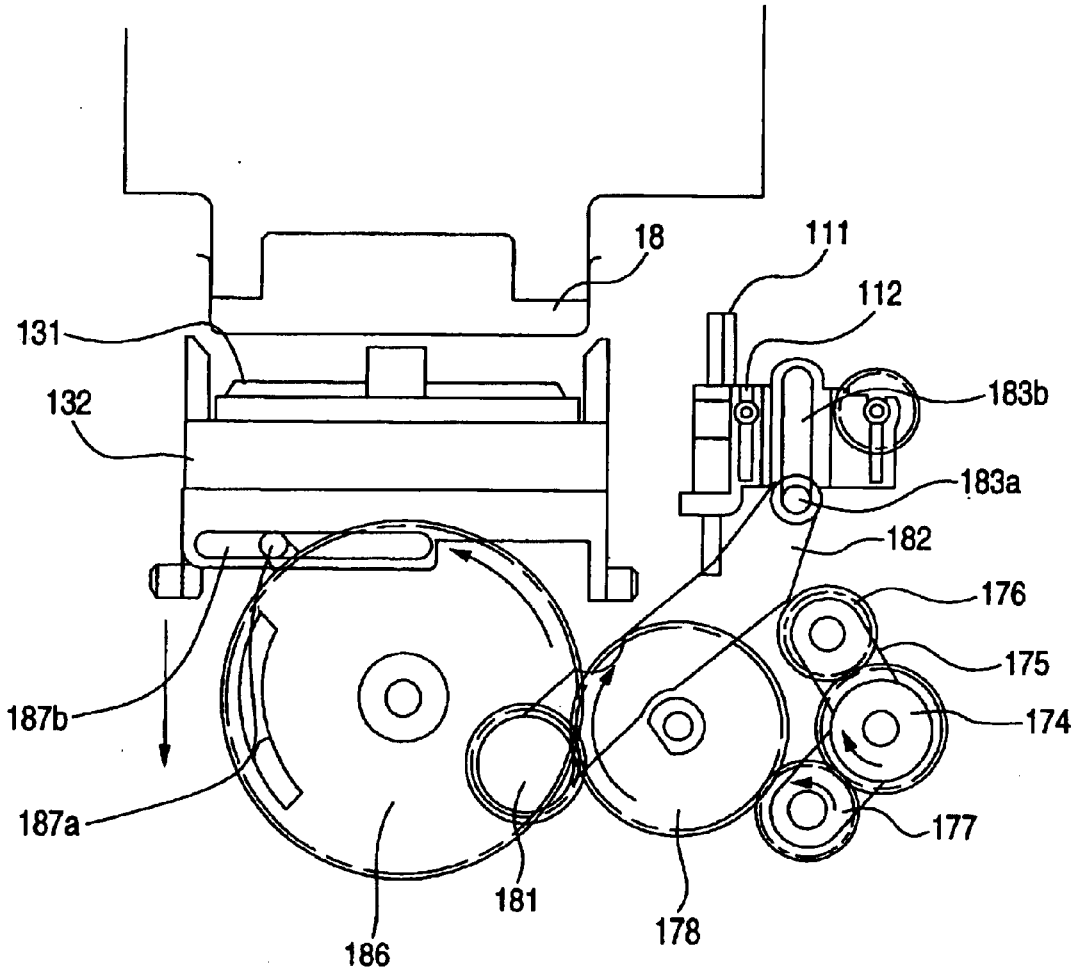

When the motor rotates in reverse in the manner as shown in FIG. 4, the capping unit 130 is situated in the uppermost position, as shown in FIG. 12. Further, the cap 131 is in a "closed" state; that is, a capped state. The wiping unit 110 is situated in the rightmost position in the drawing, and the wiper 111 is in a "reset" state; that is, a state in which the wiper 111 can perform a wiping operation in the leftward direction in the drawing. The roller of the pump that acts as the suction unit 160 has bitten the tube; that is, a sucking state (point in time t10).

Figure 11:
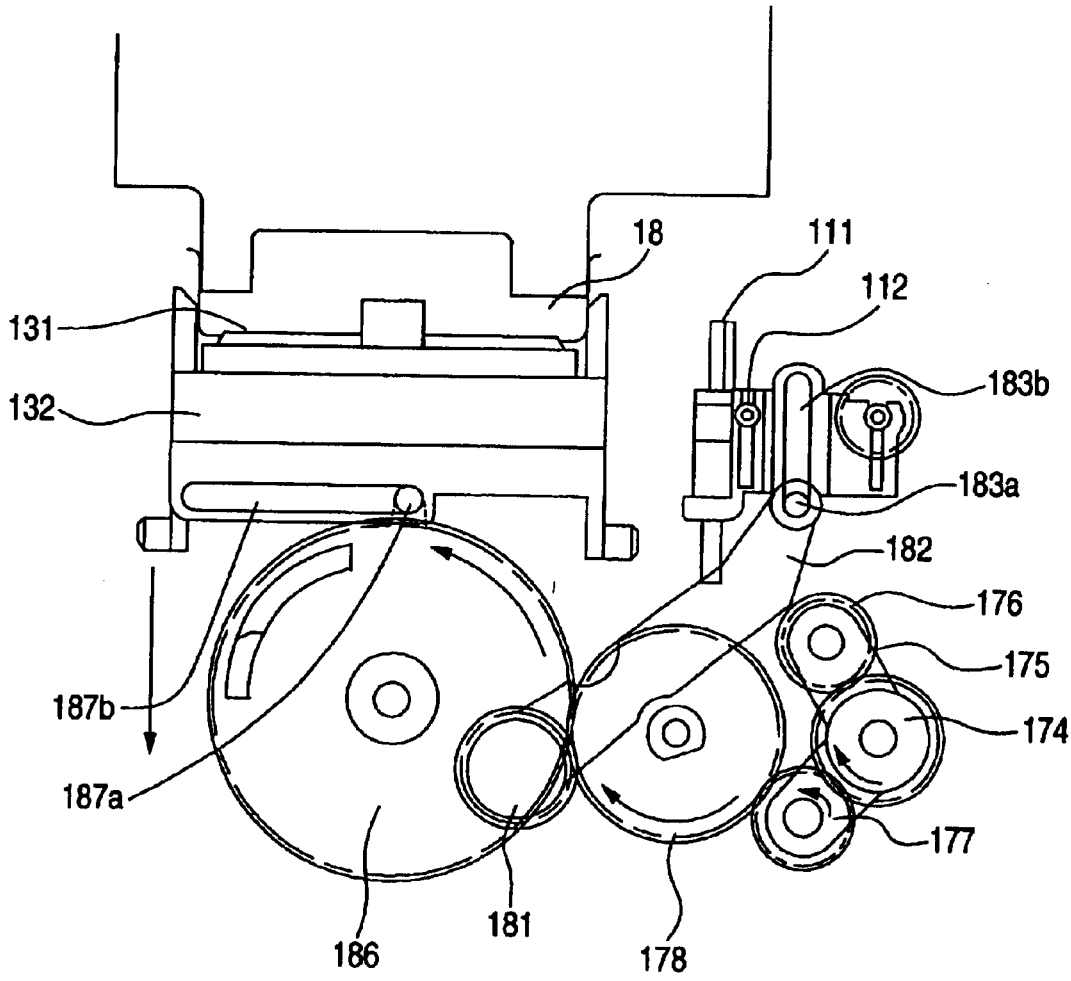
Figure 13:
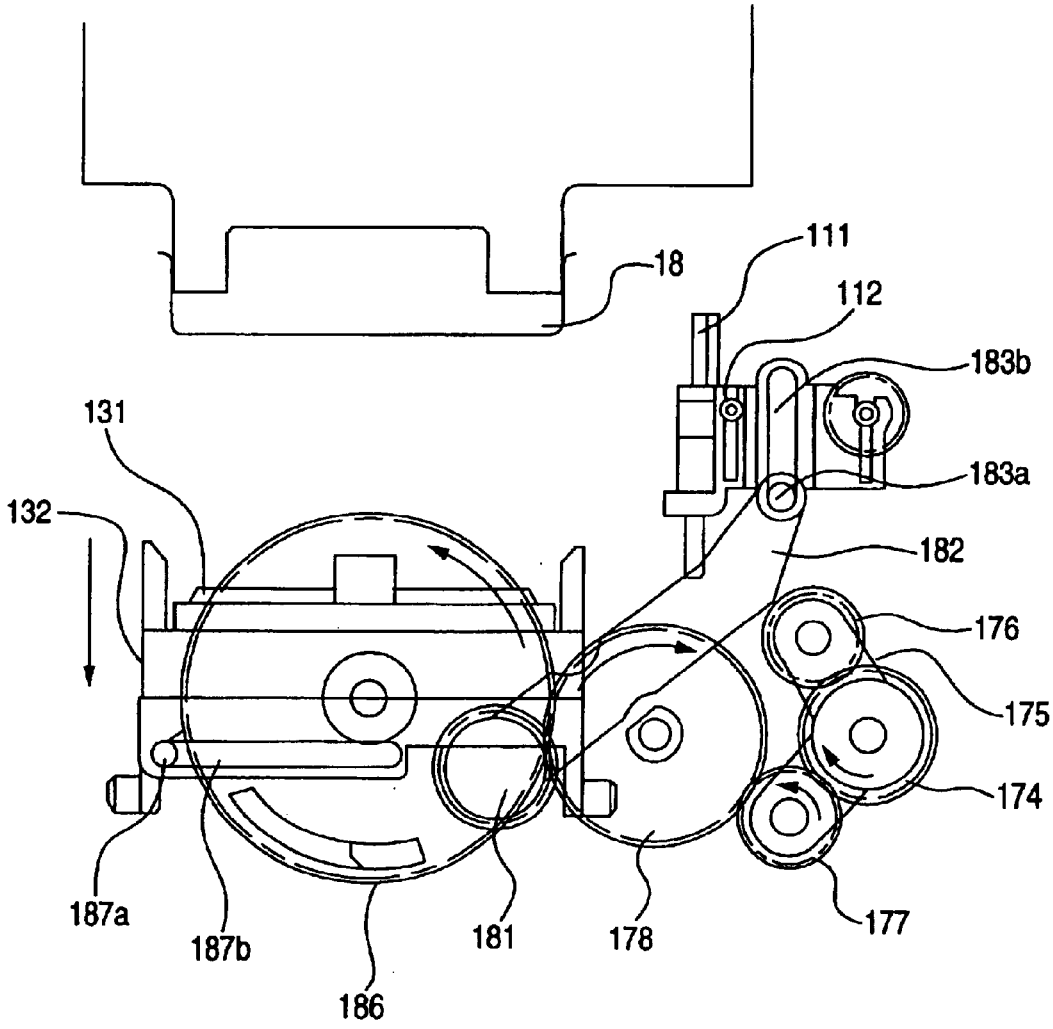

When in this state the motor is rotated in reverse, to thereby rotate the planetary lever 175, the reverse rotation planetary gear 177 meshes with the second partially-toothed gear 178*b* in the manner as shown in FIG. 11. The torque of the sun gear 174 is transmitted from the reverse rotation planetary gear 177 to the second partially-toothed gear 178*b* and from the fourth partially-toothed sear 178*d* to the cap gear 186. The cap holder 132 starts lowering by the cam mechanism 187 (point in time t7). As shown in FIGS. 12 and 13, the cap 131 gradually departs from the nozzle formation face of the print head 18.

Figure 14:
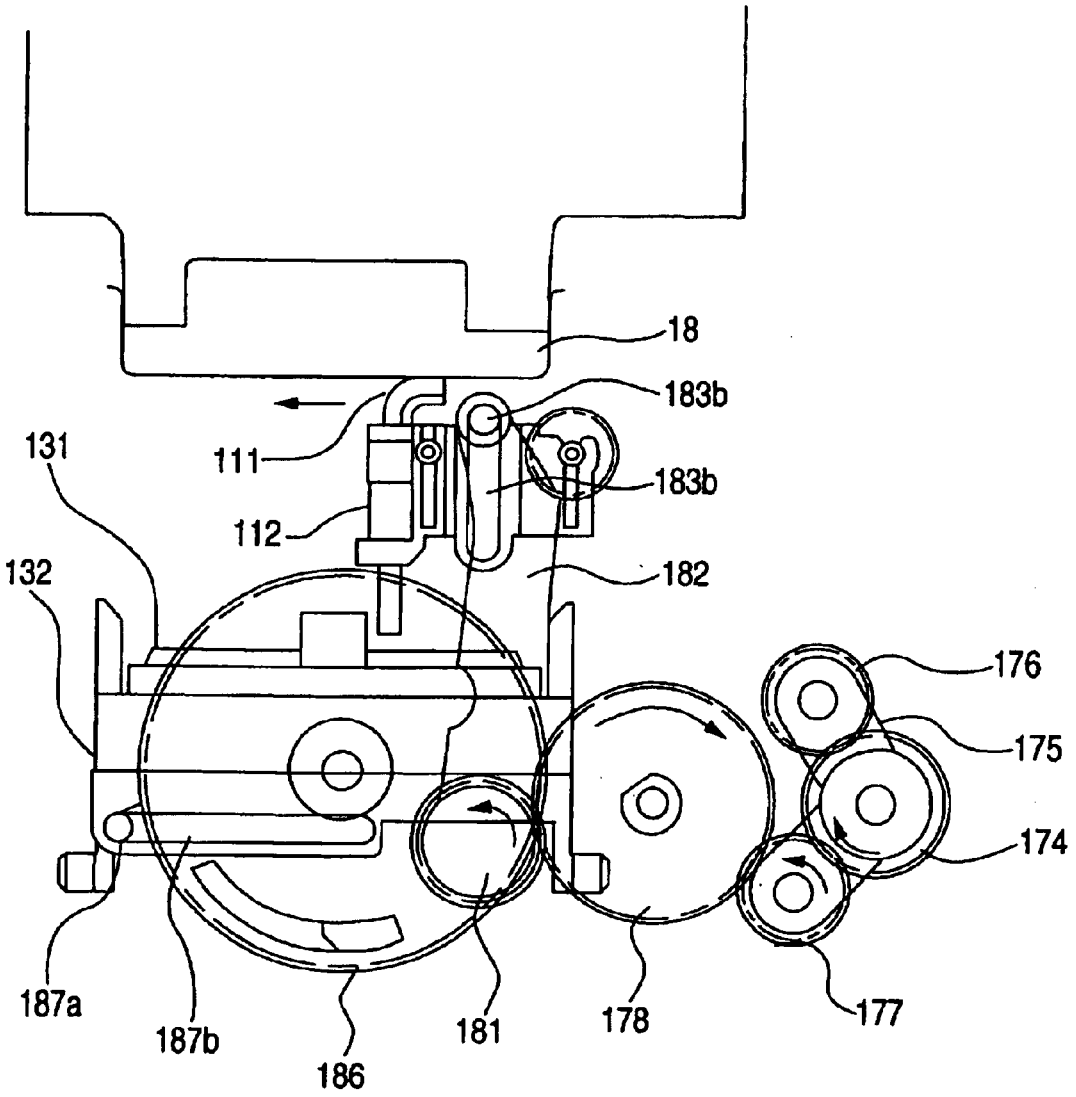

When the cap gear 186 has been disengaged from the fourth partially-toothed gear 178*d* upon reaching a toothless portion thereof, the cap gear 186 runs idly. As shown in FIG. 14, the cap holder 132 stops lowering. At this time, the capping unit 130 is situated in the lowermost end position. The cap 131 remains in an "open" state; that is, a non-capped state (point in time t6).

Figure 15:
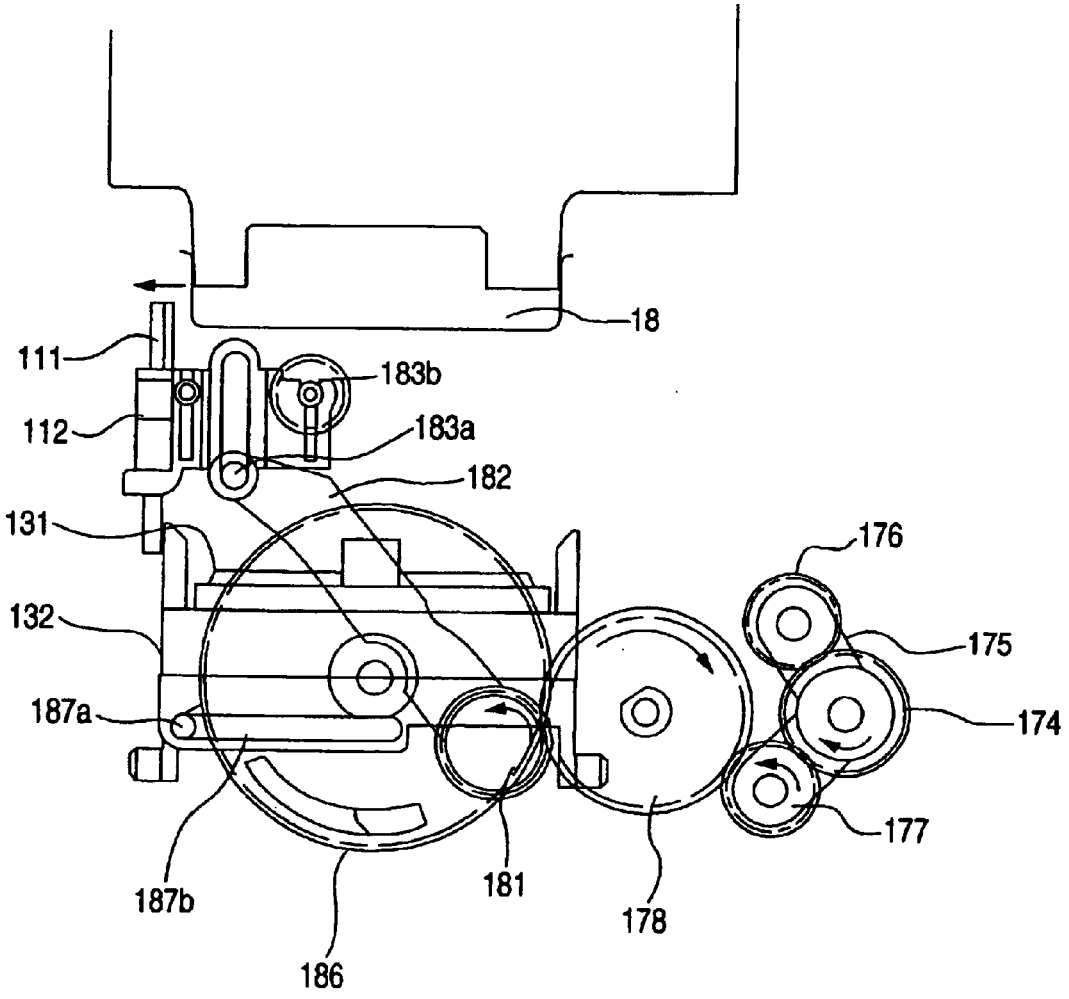

When the motor rotates in reverse, to thereby rotate the torque transmission gear 172, the torque of the sun gear 174 is transmitted from the reverse rotation planetary gear 177 to the second partially-toothed gear 178*b* and from the third partially-toothed gear 178*c* to the wiper gear 181 in the manner shown in FIGS. 14 and 15. The lever 182 is then pivoted, and the wiper holder 112 starts moving in the leftward direction in the drawing by the cam mechanism 183 (point in time t5). Then, the wiper 111 wipes away the noble formation face of the print head 18.

Figure 16:
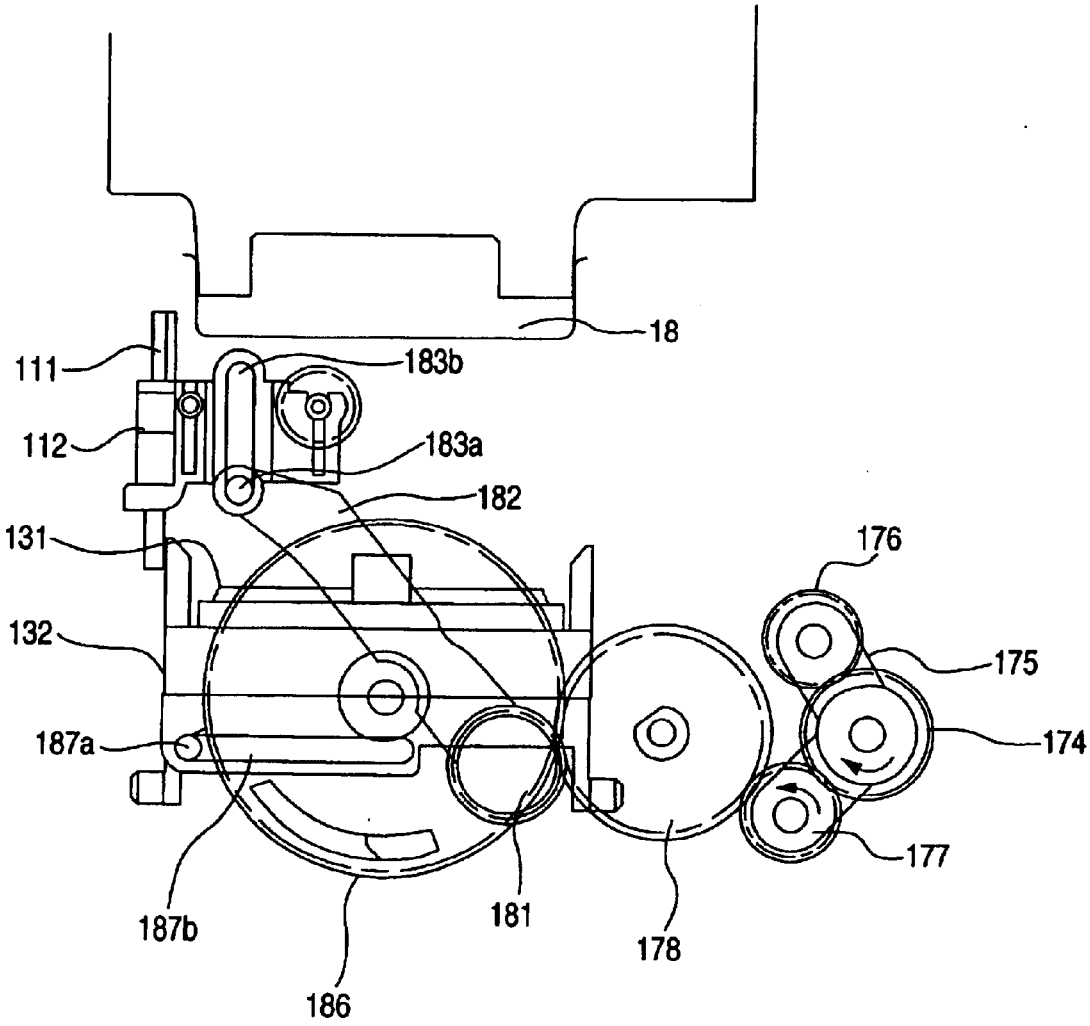

When the wiper gear 181 has been disengaged from the third partially-toothed gear 178*c* upon reaching a tooth-toothed portion thereof, the wiper gear 181 runs idly. As shown in FIG. 16, the wiper holder 112 stops moving. At this time, the wiping unit 110 is situated in the leftmost position in the drawing, and the wiper 111 remains in a "set" state; that is, a state in which the wiper 111 has finished wiping operation in the leftward direction in the drawing (point in time t4).

When in this state the motor rotates in reverse further, to thereby rotate the torque transmission gear 172, the pump wheel 192 starts rotating by way of the pump transmission wheel 191. The roller of the pump is released from the tube; that is, a non-sucking state, and rotation of the motor is stopped (points in time t3, t2). In this way, no torque is transmitted to the pump while the wiping unit 110 and the capping unit 130 are in operation.

The foregoing embodiment has described the ink ejectability maintenance device 100 equipped with one capping unit 130 and one suction unit 150; however, the invention is not limited to this embodiment. For instance, an ink ejectability maintenance device having two capping unit 130 and two suction unit 150 can also be constructed in the same manner and can attain the same effect as that attained by the device 100.

The embodiment has described the invention by taking a printer as an example. However, the invention is not limited to the printer and can also be applied to a recording apparatus having a recording medium transport guide section; for example, a facsimile device or a copier,

What is claimed is:

1. An ink ejectability maintenance device for maintaining an ink ejectability of a recording head which ejects ink droplets to a recording medium, comprising:

a wiper, having a first moving path extending in a first direction in which the recording medium is fed, to wipe a nozzle formation face of the recording head;

a cap, having a second moving path extending in a vertical direction to seal the nozzle formation face; and an absorption member, disposed below the first moving path to receive and absorb ink therein, wherein:

the first moving path is away from the second moving path in connection with a second direction perpendicular to the first direction; and a first horizontal plane in which the wiper is placed and a second horizontal plane in which the cap is placed are away from each other in the vertical direction.

2. The ink ejectability maintenance device as set forth in claim 1, further comprising a driver unit including a pair of planetary gears which transmits a driving force thereof to the wiper and the cap, and a single shaft which rotates either one of the planetary gears so that the driving force is transmitted by both of a forward rotation and a reverse rotation thereof.

3. The ink ejectability maintenance device as set forth in claim 2, wherein, the driver unit includes a sun gear meshed with the respective planetary gears and a partially-chipped gear connected to the wiper; and the partially-chipped gear includes a cog portion which meshes either one of the planetary gears when the wiper is moved, and a cogless portion which faces either one of the planetary gears after the wiper is moved.

4. The ink ejectability maintenance device as set forth in claim 3, wherein the partially-chipped gear is a four-gears unit which respectively meshes the respective planetary gears, a wiper gear for driving the wiper, and a cap gear for driving the cap.

5. The ink ejectability maintenance device as set forth in claim 4, wherein the wiper gear includes a lever and a cam mechanism for moving the wiper in the first direction, and the cap gear includes a cam mechanism for moving the cap in the vertical direction.

6. The ink ejectability maintenance device as set forth in claim 2, further comprising a suction unit which applies negative pressure to an internal space of the cap which seals the nozzle formation face, wherein the suction unit is activated after the driver unit drives the wiper and the cap.

7. A recording apparatus comprising the ink ejectability maintenance device as set forth in any one of claims 1 to 6.

8. The ink ejectability maintenance device as set forth in claim 1, wherein said absorption member is located directly below said wiper when said wiper wipes said nozzle formation face of said recording head.

9. The ink ejectability maintenance device as set forth in claim 1, wherein said wiper is movable independently of said cap.

10. The ink ejectability maintenance device as set forth in claim 1, wherein said wiper is capable of moving along said first moving path while said cap remains stationary relative to said nozzle formation.

11. The ink ejectability maintenance device as set forth in claim 1, wherein said cap is movable independently of said wiper.

12. The ink ejectability maintenance device as set forth in claim 1, wherein said cap is capable of moving along said second moving path while said wiper remains stationary relative to said nozzle formation.

13. The ink ejectability maintenance device as set forth in claim 1, wherein said cap is movable independently of said recording head.

14. The ink ejectability maintenance device as set forth in claim 1, wherein said wiper is movable independently of the recording head.

15. The ink ejectability maintenance device as set forth in claim 1, wherein said wiper is positioned between said nozzle formation and said cap during said wiping operation.

16. An ink ejectability maintenance device for maintaining an ink ejectability of a recording head which ejects ink droplets to a recording medium, comprising:

a wiper, movable in a first moving path extending in a direction in which the recording medium is fed, to wipe a nozzle formation face of the recording head;

a cap, movable in a second moving path, to seal the nozzle formation face; and an absorption member, disposed below the first moving path, to receive and absorb ink therein, wherein:

the first moving path is perpendicular to the second moving path; and a first horizontal plane in which the wiper is placed and a second horizontal plane in which the cap is placed are spaced away from each other in the vertical direction.

17. An ink ejectability maintenance device for maintaining an ink ejectability of a recording head which ejects ink droplets to a recording medium, comprising:

wiping means, movable in a first moving path extending in a direction in which the recording medium is fed, for wiping a nozzle formation face of the recording head;

cap means, movable in a second moving path, for sealing the nozzle formation face; and absorption means, disposed below the first moving path, for receiving and absorbing ink therein, wherein:

the first moving path is perpendicular to the second moving path; and a first horizontal plane in which the wiping means is placed and a second horizontal plane in which the cap means is placed are spaced away from each other in the vertical direction.

* * * * *

UNITED STATES PATENT AND TRADEMARK OFFICE

CERTIFICATE OF CORRECTION

PATENT NO. : 6,742,863 B2
DATED : June 1, 2004
INVENTOR(S) : Nobuhito Takahashi

It is certified that error appears in the above-identified patent and that said Letters Patent is hereby corrected as shown below:

Title page,
Item [54], Title, reads "INK EJECTABILTY MAINTENACE DEVICE, AND RECORDING APPARATUS INCORPORATING THE DEVICE" and replace it with -- INK EJECTABILITY MAINTENANCE DEVICE, AND RECORDING APPARATUS INCORPORATING THE DEVICE --

Signed and Sealed this

Twenty-second Day of February, 2005

JON W. DUDAS
*Director of the United States Patent and Trademark Office*